US006003605A

United States Patent [19]

Dickson et al.

[11] Patent Number: 6,003,605

[45] Date of Patent: Dec. 21, 1999

[54] BALANCED LINE TUBING RETRIEVABLE SAFETY VALVE

[75] Inventors: Rennie L. Dickson; Nam Van Le, both of Carrollton, Tex.

[73] Assignee: Halliburton Enery Services, Inc., Dallas, Tex.

[21] Appl. No.: 08/980,593

[22] Filed: Dec. 1, 1997

[51] Int. Cl.[6] ..... E21B 34/10

[52] U.S. Cl. ..... 166/375; 166/324; 166/332.8; 251/58; 251/63.4; 251/228; 251/303

[58] Field of Search ..... 166/324, 321, 166/336, 375, 374, 332.8; 251/63.4, 228, 58, 303

[56] References Cited

U.S. PATENT DOCUMENTS

| | | | |
|---|---|---|---|
| 3,696,868 | 10/1972 | Taylor, Jr. | 166/375 |
| 4,149,698 | 4/1979 | Deaton | 251/63.6 |
| 4,376,464 | 3/1983 | Crow | 166/324 |
| 4,531,587 | 7/1985 | Fineberg | 166/332.8 |
| 4,660,646 | 4/1987 | Blizzard | 166/321 |
| 5,564,502 | 10/1996 | Crow et al. | 166/386 |
| 5,752,569 | 5/1998 | Bhavsar et al. | 166/324 |

*Primary Examiner*—Roger Schoeppel
*Attorney, Agent, or Firm*—William M. Imwalle; Lawrence R. Youst

[57] ABSTRACT

A tubing retrievable surface controlled subsurface safety valve 106 is adapted to be positioned in a well tubing string 102 to control the flow through the tubing string. The safety valve includes an annular housing or body 200 defining a fluid passageway through which fluids and/or gasses may flow to the surface. The safety valve is equipped with a valve closure member such as flapper 252, positioned in the fluid passageway which is moveable between an open and closed position. The valve closure member is engaged and actuated by a longitudinally extending operator 242 that engages the valve closure member 252. In one embodiment, the longitudinally extending operator 242 may be a tubular member longitudinally moveable within the valve body. The longitudinally extending member 242 is operatively coupled to a spring guide 226. A biasing spring 222 is positioned in a spring chamber 120 defined by a spring housing 228 and the spring guide 226. A spring 256 biases the closure member 252 in the closed position. A balance line 114 extending from the surface is connected to a balance pressure conduit 118 that is in fluid communication with the spring chamber 120 to balance the hydrostatic pressure from the control line 112. The spring chamber 120 is isolated from well pressure at the top and bottom therefore the pressure applied to the spring chamber 120 through the balance pressure line via the balance pressure conduit 118 counteracts the hydrostatic head of the fluid in the control line or lines, thereby enabling the subsurface safety valve 106 to operate at vary depths.

27 Claims, 5 Drawing Sheets

BALANCED LINE TUBING RETRIEVABLE SAFETY VALVE

TECHNICAL FIELD OF THE INVENTION

The present invention relates in general to a balanced type down-hole surface controlled valve alternatively known as a non-well sensitive Tubing Retrievable subsurface Safety Valve ("TRSV") and a method for utilizing the same. In one embodiment, the invention relates to a balanced rod and piston type safety valve used in subsurface down-hole applications.

BACKGROUND OF THE INVENTION

Without limiting the scope of the present invention, its background will be described with reference to controlling the operation of a down-hole safety valve. An important consideration involved in the operation of hydrocarbon fluid wells is the ability to cut off the flow of fluids or gas in the event of emergencies, equipment problems or similar situations.

An important consideration in the selection of surface controlled subsurface safety valves is that valve closure be essentially failsafe. Consequently, subsurface safety valves are normally configured to be in a closed position absent operator control. Typically a subsurface safety valve is biased to the closed position through the use of one or more springs, configured to close the valve in the event that operator control is lost. In the case of hydraulically controlled rod-piston type safety valves, the valve is opened with the application of hydraulic pressure to a piston which actuates the valve, positioning it in an open position. If control pressure is lost the valve closes.

Control of conventional hydraulically operated, spring loaded rod-piston type downhole safety valves is, however, limited by the hydrostatic force applied to the piston. Ideally, a hydraulically controlled downhole safety valve would be designed to operate over a wide range of downhole locations, independent of the depth at which the valve is positioned. However, the hydrostatic force applied by the column of fluid in the control line varies with the depth at which the valve is positioned while the counteracting spring force biasing the safety valve closed is constant. Thus, if the valve is positioned at a depth such that the hydrostatic pressure or force generated by the column of fluid in the control line or tube is greater than the biasing force exerted by the spring mechanism, the valve will not close in response to a decrease in control pressure.

In the past, attempts have been made to compensate for the hydrostatic head of control pressure fluid through the use of well fluid pressure to balance the hydrostatic head which tends to inhibit valve closure. The use of well fluid pressure to balance the valve, however, requires contact between well fluids and internal components of the safety valve. Since well fluids may contain abrasive and corrosive materials that tend to impede the function of the equipment, this approach presents considerable drawbacks in terms of equipment durability and reliability. Further, the use of well pressure to balance the valve against the hydrostatic head of the control line requires additional components in terms of specialized seals designed to protect the valve components. Additionally, due to the corrosive and abrasive nature of well fluids, this approach may require the use of special materials to manufacture valve components capable of withstanding contact with well fluids.

Thus, there exists a need for an improved surface controlled pressure balanced subsurface safety valve that overcomes the limitations of the prior art.

SUMMARY OF THE INVENTION

The present invention disclosed herein comprises a pressure balanced or well insensitive downhole or subsurface safety valve. The tubing retrievable surface controlled subsurface safety valve of the present invention is adapted to be positioned in a well tubing string to control the flow through the tubing string. The safety valve includes an annular housing defining a fluid passageway through which fluids and/or gasses may flow to the surface. The safety valve is equipped with a valve closure member, such as a flapper, positioned in the fluid passageway which is moveable between an open and closed position. The valve closure member is engaged and actuated by a longitudinally extending operator that engages the valve closure member. In one embodiment, the longitudinally extending operator may be a tubular member longitudinally moveable within the valve body. The longitudinally extending member is operatively coupled to a biasing spring positioned in a spring chamber defined by a spring housing and a spring guide for biasing the closure member in a closed position.

A piston rod slidably positioned in a piston rod bore for reciprocal movement rod engages and compresses the spring upon application of control pressure. Control pressure is applied to the piston rod bore and the piston via a control pressure conduit which, in turn is connected to a control line for surface control of the valve. Compression of the spring urges the longitudinally extending operator downward to engage and open the closure member.

Since the depth at which a conventional spring loaded subsurface safety valve can be operated is limited due to the hydrostatic pressure generated by the column of fluid in the control lines, the present invention provides a balancing means compensating for the hydrostatic pressure of the fluid in the control line. The balancing means includes a balance pressure conduit communicating with the spring chamber which in turn is connected with a balance pressure line for surface control. The spring chamber is isolated from Is well pressure at the top and bottom, thus, pressure applied to the spring chamber counteracts the hydrostatic head of the fluid in the control line or lines.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not limit the scope of the invention.

Figure 1:
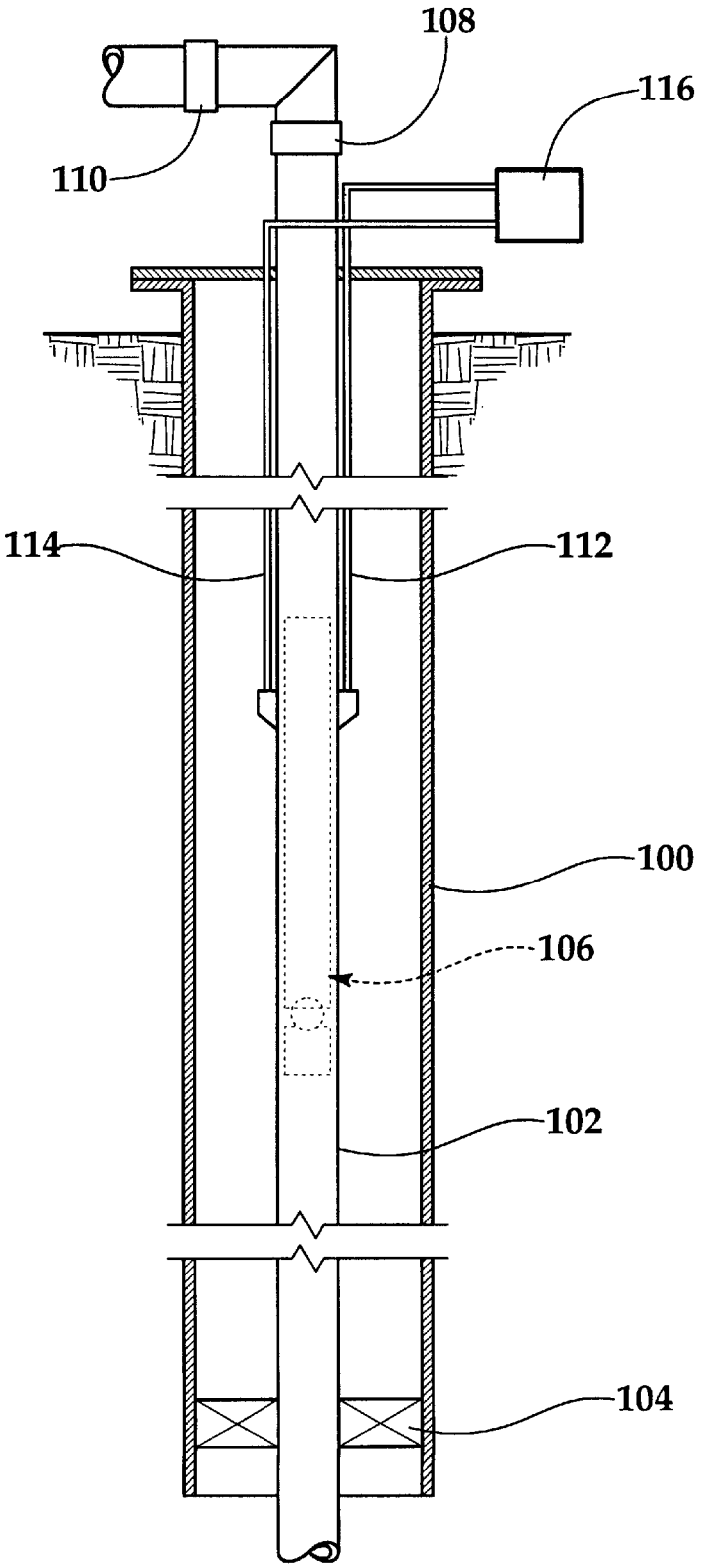
FIG. 1 is a schematic illustration of the subsurface safety control valve of the present invention deployed in a downhole application.

Referring now to FIG. 1, a well installation incorporating the features of the present invention is schematically illustrated. The well is cased with a normal casing string 100. A tubing string 102 extends through the casing string for conventional extraction of hydrocarbon fluids and gasses. Hydrocarbon fluids from a producing formation are contained within the tubing 102 by means of packers 104. Fluid flow through the tubing string may be controlled via subsurface safety valve 106. At the well surface, fluid flow may be controlled by valves 108 and 110.

In order to operate the subsurface safety valve 106 from the surface, control line 112 and balance line 114 are provided. In order to open the subsurface safety valve 106, hydraulic pressure is applied via control line 112. In accordance with the present invention, balance line 114 is provided for the purpose of suppling a balancing pressure to compensate for the effects of hydrostatic pressure on the control line. Control of the hydraulic pressure applied via control line 112 and balance line 114 is effectuated through, for example control manifold 116, located on the surface.

Figure 2A:
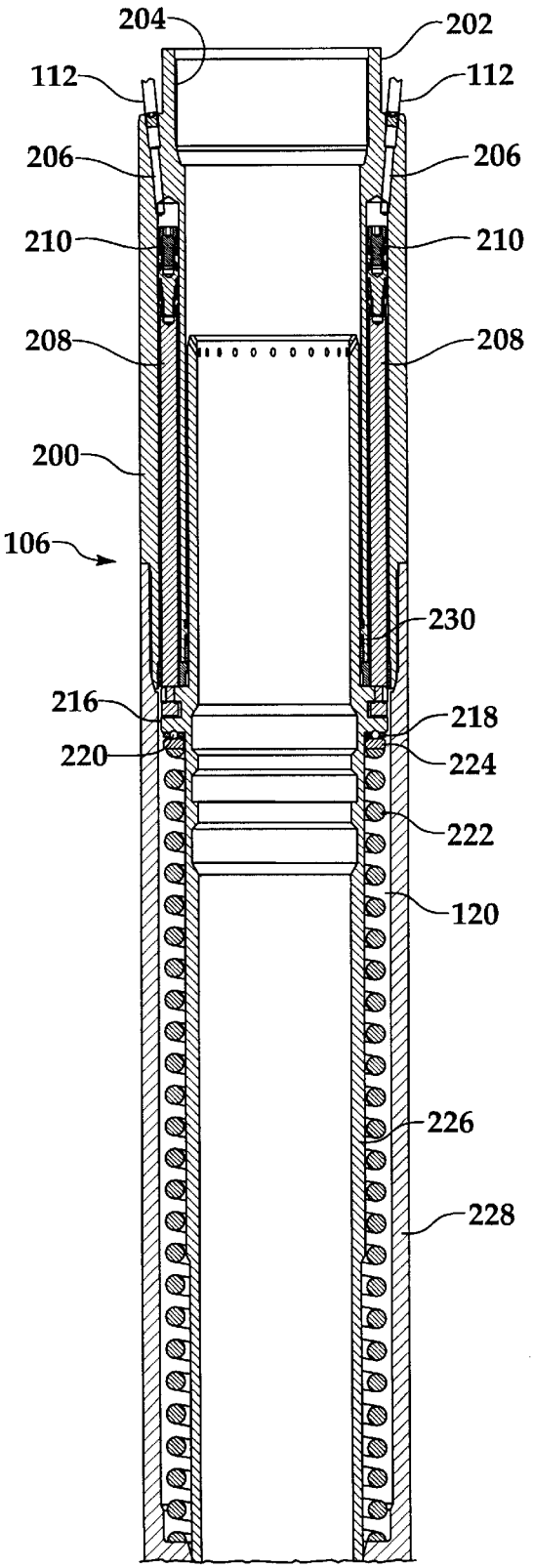
FIGS. 2A–B are cross-sectional views of the subsurface safety valve in a closed position.
Figure 3A:
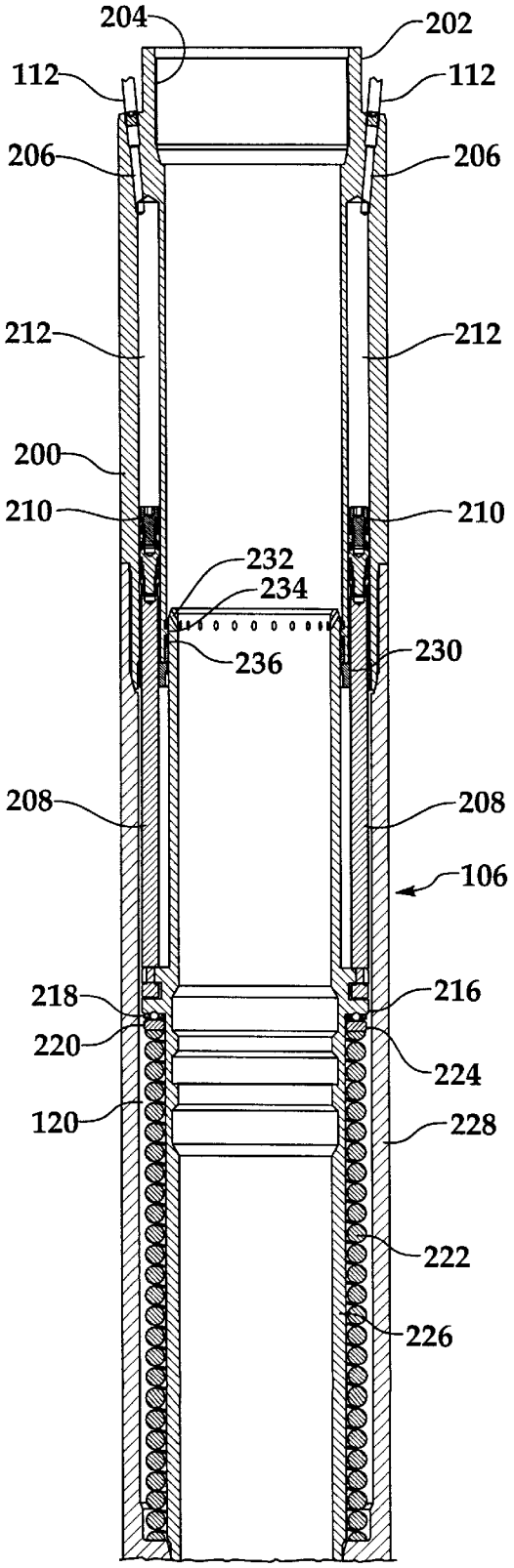
FIGS. 3A–B are cross-sectional views of the subsurface safety valve in an open position.
Figure 2B:
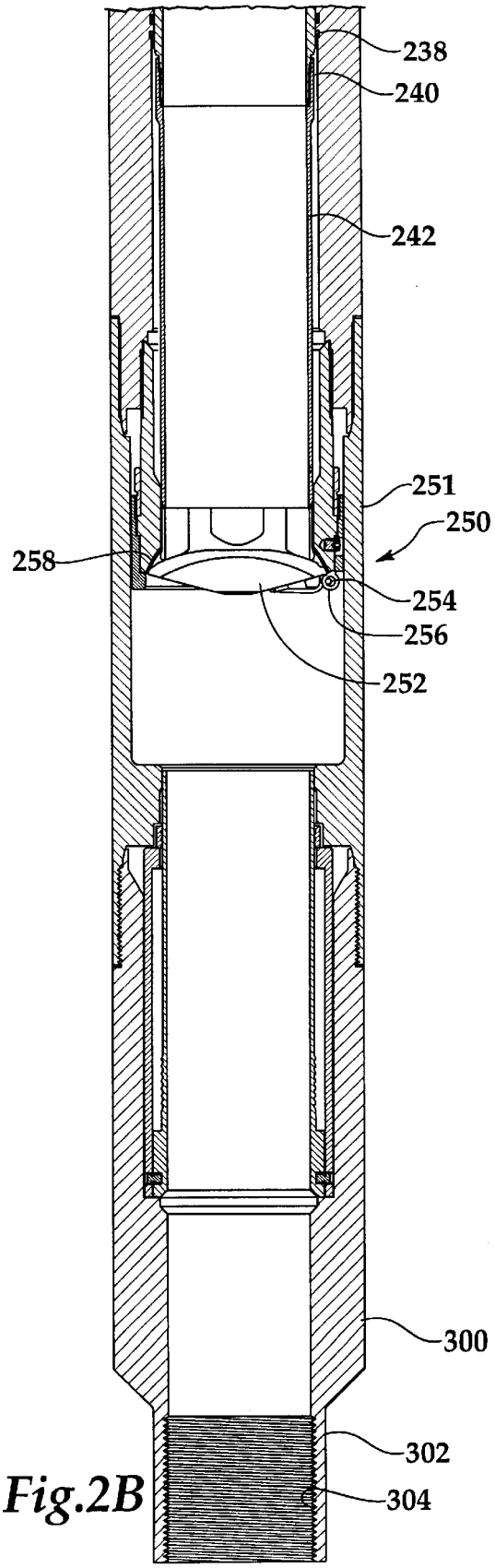
Figure 3B:
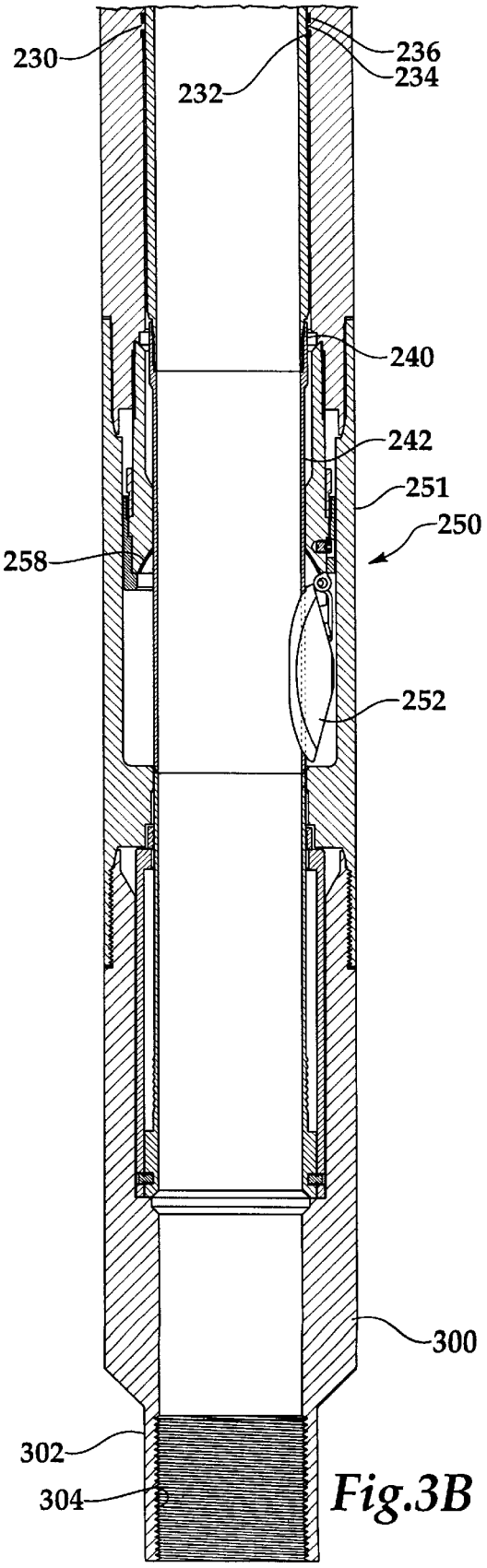

Turning now to FIGS. 2A–B and 3A–B, the structure and operation of the subsurface safety valve of the present invention is described in greater detail. FIGS. 2A–B and 3A–B are essentially identical except that FIGS. 2A–B depict the subsurface safety valve in a closed position whereas FIGS. 3A–B illustrate the valve in the open position. The tubing retrievable safety valve includes a top sub or annular body 200 comprising an annular housing defining a fluid passageway, with a neck portion 202 including threaded portion 204 for engaging the tubing string. The tubing replaceable safety valve also includes a similarly configured bottom sub or annular body 300 including neck portion 302 with threaded portion 304 for engaging the tubing string. One or more control tubes or lines 112 are connected to control conduits 206 for transmitting hydraulic control pressure to cylinder or piston rod bore 212.

Figure 5:
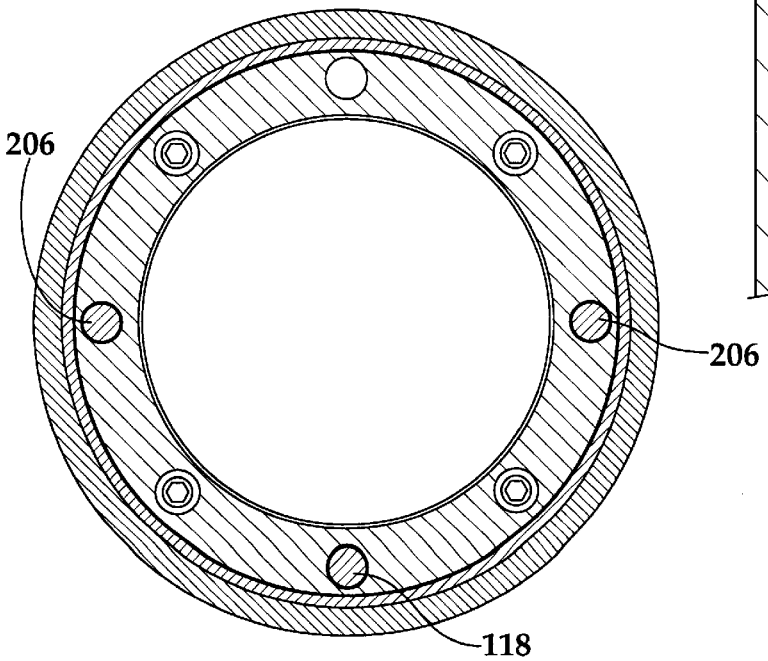
FIG. 5 is a cross-sectional view of the top sub of the present invention, illustrating the relative position of control and balance lines utilized in the method of the present invention.

As best illustrated in FIG. 5, in one embodiment of the present invention, two control conduits 206 disposed radially at 180 degrees relative to each other, extend through top sub 200. Also, as illustrated in FIG. 5, a third or balance conduit 118 is positioned radially at 90 degrees from the control conduits for transmission of balance pressure. Although the illustrated embodiment shows two control conduits and one balance conduit, it will be appreciated by those skilled in the art the number of conduits as well as the number of balance and control lines utilized in the practice of the present invention may be varied depending upon the specific application.

Figure 4:
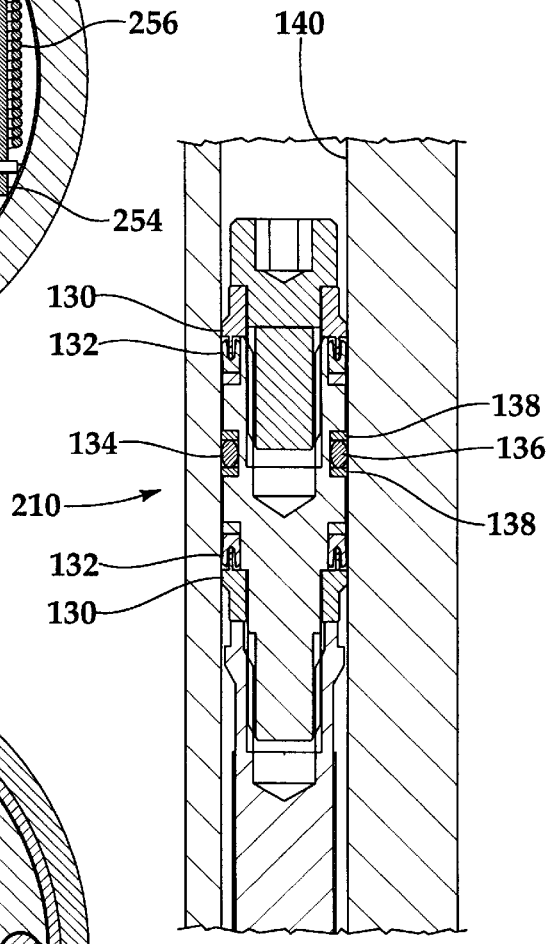
FIG. 4 is a cross-sectional view of a sealing assembly utilized in connection with a piston rod assembly of the present invention.

A piston rod 208 is moveably positioned in piston rod bore 212 for reciprocal movement in a longitudinal direction relative to the tubing string 102. Piston rod seal assembly 210, described in greater detail in connection with FIG. 4, isolates piston rod 208 from piston rod bore 212. In accordance with the present invention, hydraulic pressure applied via a control tube or line 112 is communicated via a control conduit 206 to a piston rod bore 212 to reciprocate piston rod 208 in an axial direction. It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. Thus, it is to be understood that subsurface safety valve 106 may be operated in vertical, horizontal, inverted or inclined orientations without deviating from the principles of the present invention.

Turning now to FIG. 4, the rod piston seal assembly 210 includes upper and lower concentric non-elastomer seal members 130 urged into sealing engagement with annular wall 140 of piston rod bore 214 by energizing springs 132. In the illustrated embodiment, dynamic seals are is also provided. Dynamic seal 134 includes an O-ring 136 interposed between retainers 138. While the illustrated embodiment shows one possible sealing assembly, it is contemplated that in the practice of the present invention, alternative sealing mechanisms may be used.

Referring again to FIGS. 2A–B and 3A–B, upon actuation by the application of control pressure, piston rod 208, in turn, engages concentric bearing assembly 218 which includes bearings 216 and bearing retainer 220 to transmit compressive force to spring 222. The use of concentric bearing assembly reduces any torsional effects resulting from the use of helical spring 222 to bias the valve and thus, in turn, reduces wear on other parts of the valve assembly. Spring 222 is positioned in sealed spring chamber 120 between spring housing 228 and spring guide 226 to control movement of the spring in a longitudinal direction relative to the axis of the tubing string 102. A concentric spring compression ring 224 is interposed between bearing assembly 218 and spring 222 to provide uniform transmission of force from the piston rod 208 to the spring 222.

Spring 222 is positioned in chamber 120 between spring house 228 and spring guide 226 for compression in a longitudinal axis relative to the tubing string. A dynamic seal assembly 230 is provided to insure an adequate seal between the piston rod bore 212 and spring housing 228 to isolate the spring chamber 120 from well pressure.

Dynamic seal assembly 230 may, as illustrated, include a lip seal 232, a back up or retaining ring 234 and an O-ring 236. The sealing assembly insures isolation between well fluids and the safety valve assembly as piston rod 208 reciprocates in a longitudinal direction relative to the tubing string 102. As illustrated, the same sealing mechanism is used to isolate the spring housing 228 adjacent the bottom of spring chamber 120, including a lip seal 232, a back up or retaining ring 234 and an O-ring 236. Additionally, piston rod guide 238 controls movement of piston rod 208 in a lateral direction relative to the longitudinal axis of the tubing string.

As best illustrated in FIGS. 3A–B, upon compression of spring 222, spring housing 228 is displaced downwardly. Shoulder 240 engages longitudinally extending operator 242, displacing the operator in a downward axial direction. Operator 242 in turn engages valve assembly 250 to place the valve in an open position. As illustrated, valve assembly 250 is a flapper-type valve enclosed in valve housing 251. It is, however, contemplated that other valve types, such as a ball valve may be advantageously utilized in the practice of the present invention. Similarly, as illustrated longitudinally extending operator 242 is a tubular member extending axially relative to the tubing string, however it is contemplated that other geometries may be utilized in the practice of the present invention.

Figure 6:
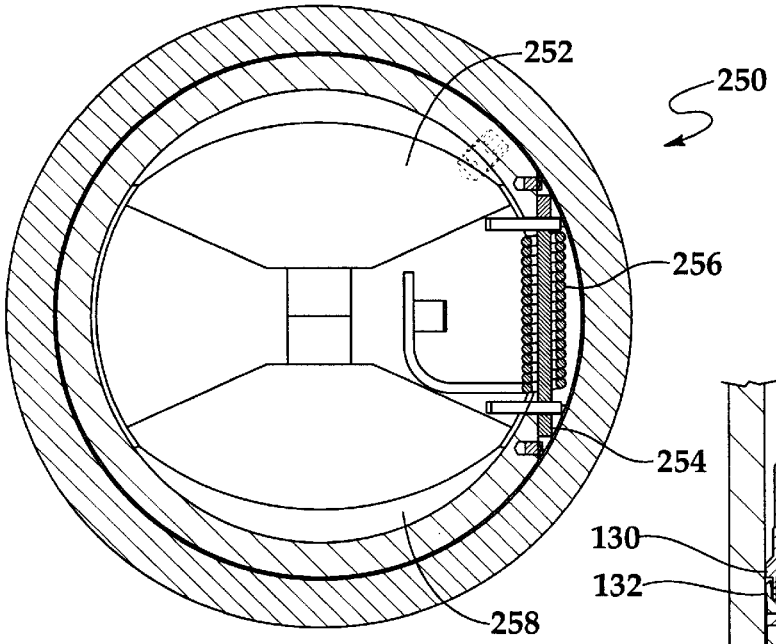
FIG. 6 is isometric view of a valve closure member of the invention.

As noted above, upon compression of spring 222, operator 242 is displaced in an axial direction, thereby engaging flapper valve assembly 250. As best illustrated in FIG. 6, flapper valve assembly 250 includes closure member or flapper 252 pivotally mounted on flapper pin 254 and tension spring 256. In the closed position, the flapper 252 seals against valve seat 258. Tension spring 256 biases flapper to the closed position to aid in sealing to flapper 252 against valve seat 258. In the illustrated embodiment, the flapper 252 is oval, however other geometries may be applicable.

As should be appreciated by those skilled in the art, the depth at which a spring biased subsurface safety valve can be operated is limited due to the hydrostatic pressure generated by the column of fluid in the control tubes or lines 112. Since the hydrostatic force applied by the column of fluid in the control line varies with the depth at which the valve 106 is positioned, the constant counteracting spring force biasing the safety valve can be overcome by the hydrostatic head, rendering the valve inoperative at greater than design depths.

Figure 7:
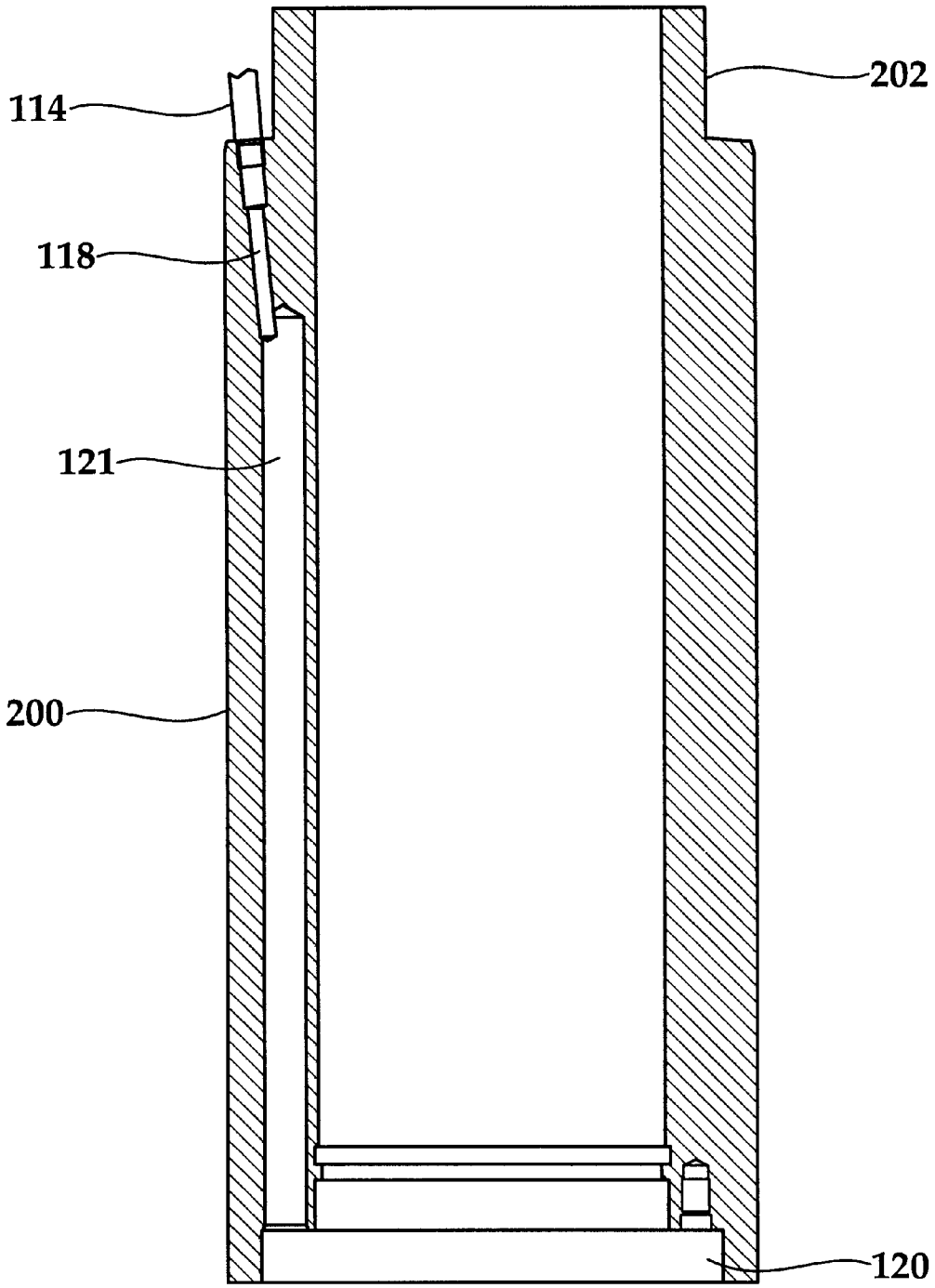
FIG. 7 is a partial cross-sectional view of the top sub of the valve of the invention, illustrating one conduit for the transmittal of balance pressure.

Referring again to figures, 2A–B and 3A–B, in accordance with the present invention, the subsurface safety valve 106 is isolated from well pressure by dynamic seal assemblies 230. In order to enable the subsurface safety valve to operate at depths where the biasing force provided by spring 222 would be overcome by the hydrostatic force of the fluid in control line 112, it is necessary to balance the hydrostatic forces. In order to counteract the hydrostatic head of the control line, balance line 114 supplies hydraulic pressure via balance conduit 118 to spring chamber 120. Thus, when subsurface safety valve 106 is positioned at a depth where the hydrostatic head in control line 112 is sufficient to overcome the biasing force of spring 222, a compensating force may be applied via balance line 114 through conduit 118 and passageway 121 to spring chamber 120 as best seen in FIG. 7. The balancing force allows the safety valve 106 to be positioned at various depths irrespective of the biasing force applied by spring 222. Thus, the present invention provides a depth or well-insensitive subsurface safety valve capable of being operated over a wide range of depths, irrespective of the particular biasing spring design.

While the invention has been described in connection with the appended drawings, the description is not to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments within the spirit and scope of the invention.

What is claimed is:

1. A subsurface safety valve adapted to be positioned in a tubing string to control the flow through the tubing string comprising:

a housing having first and second piston bores;

first and second pistons slidably positioned respectively in the first and second piston bores, the pistons being isolated from well pressure;

a spring housing securably coupled to the housing;

a spring guide slidably disposed within the spring housing, the spring housing and spring guide defining a spring chamber having a spring disposed therein, the spring biasing the spring guide in a first direction, the spring being isolated from well pressure;

an operator securably attached to the spring guide for operating the safety valve from a closed position to an open position; and first and second control pressure conduits respectively coupled to the first and second piston bores communicating control pressure to the pistons to bias the spring guide in a second direction, thereby operating the safety valve to the open position.

2. The safety valve of claim 1 further comprising a valve closure member positioned within the safety valve, the valve closure member moveable between open and closed positions.

3. The safety valve of claim 1 further comprising first and second seals isolating the pistons and the spring from well pressure.

4. The safety valve of claim 3 wherein the first seal is interposed between the spring guide and the housing and the second seal is interposed between the spring housing and the spring guide, the first and second seals isolating the spring from well pressure.

5. The safety valve of claim 3 wherein the operator further comprises a tubular member positioned for axial movement relative to the tubing string.

6. The safety valve of claim 2 wherein the valve closure member comprises a flapper valve.

7. The safety valve of claim 2 further comprising a tensioning spring for biasing the valve closure member to the closed position.

8. The safety valve of claim 1 further comprising a balance pressure conduit in fluid communication with the spring chamber for transmitting balance pressure to the spring chamber.

9. The safety valve of claim 8 wherein a plurality of balance pressure conduits communicate with the spring chamber.

10. A method for controlling flow through a tubing string with a subsurface safety valve comprising the steps of:

positioning the safety valve in the tubing string;

slidably positioned first and second pistons in first and second piston bores formed in a housing of the safety valve;

isolating the pistons from well pressure;

disposing a spring in a spring chamber formed between a spring housing and a spring guide, the spring housing securably coupled to the housing, the spring guide slidably disposed within the spring housing;

biasing the spring guide in a first direction with the spring;

isolating the spring from well pressure;

communicating control pressure to the pistons through first and second control pressure conduits respectively coupled to the first and second piston bores to bias the spring guide in a second direction; and operating the safety valve from a closed position to an open position with an operator that is securably attached to the spring guide.

11. The method of claim 10 further comprising the step of positioning a valve closure member within the safety valve that is moveable between open and closed positions.

12. The method of claim 11 further comprising the step of biasing the valve closure member to the closed position with a tensioning spring.

13. The method of claim 10 further comprising the step of supplying balance pressure through a balance pressure conduit to the spring chamber.

14. The method of claim 10 wherein the steps of isolating the pistons from well pressure and isolating the spring from well pressure further comprise interposing a first seal between the spring guide and the housing and interposing a second seal between the spring housing and the spring guide.

15. The method of claim 10 wherein the valve closure member comprises a flapper valve.

16. A subsurface safety valve adapted to be positioned in a tubing string to control the flow through the tubing string comprising:

a housing having first and second piston bores;

first and second pistons slidably positioned respectively in the first and second piston bores, the pistons being isolated from well pressure;

a spring housing securably coupled to the housing;

a spring guide slidably disposed within the spring housing, the spring housing and spring guide defining a spring chamber having a spring disposed therein, the spring biasing the spring guide in a first direction, the spring being isolated from well pressure;

a balance pressure conduit in fluid communication with the spring chamber for transmitting balance pressure to the spring chamber and biasing the spring guide in the first direction;

an operator securably attached to the spring guide for operating the safety valve from a closed position to an open position; and first and second control pressure conduits respectively coupled to the first and second piston bores communicating control pressure to the pistons to bias the spring guide in a second direction, thereby operating the safety valve to the open position.

17. The safety valve of claim 16 further comprising a valve closure member positioned within the safety valve and moveable between open and closed positions.

18. The safety valve of claim 17 wherein the valve closure member further comprises a flapper valve.

19. The safety valve of claim 16 further comprising first and second seals isolating the pistons and the spring from well pressure.

20. The safety valve of claim 19 wherein the first seal is interposed between the spring guide and the housing and the second seal is interposed between the spring housing and the spring guide.

21. The safety valve of claim 16 wherein the operator further comprises a tubular member positioned for axial movement relative to the tubing string.

22. The safety valve of claim 16 wherein a plurality of balance pressure conduits communicate with the spring chamber.

23. A method for controlling flow through a tubing string with a subsurface safety valve comprising the steps of:

positioning the safety valve in the tubing string;

slidably positioned first and second pistons in first and second piston bores formed in a housing of the safety valve;

isolating the pistons from well pressure;

disposing a spring in a spring chamber formed between a spring housing and a spring guide, the spring housing securably coupled to the housing, the spring guide slidably disposed within the spring housing;

biasing the spring guide in a first direction with the spring;

isolating the spring from well pressure;

supplying balance pressure through a balance pressure conduit to the spring chamber to bias the spring guide in the first direction;

communicating control pressure to the pistons through first and second control pressure conduits respectively coupled to the first and second piston bores to bias the spring guide in a second direction, thereby operating the safety valve to the open position; and operating the safety valve from a closed position to an open position with an operator that is securably attached to the spring guide.

24. The method of claim 23 further comprising the step of positioning a valve closure member within the safety valve that is moveable between open and closed positions.

25. The method of claim 24 wherein the valve closure member comprises a flapper valve.

26. The method of claim 24 further comprising the step of biasing the valve closure member to the closed position with a tensioning spring.

27. The method of claim 23 wherein the steps of isolating the pistons from well pressure and isolating the spring from well pressure further comprise interposing a first seal between the spring guide and the housing and interposing a second seal between the spring housing and the spring guide.

* * * * *